US006827967B2

(12) United States Patent
Besnard

(10) Patent No.: US 6,827,967 B2
(45) Date of Patent: Dec. 7, 2004

(54) TREATMENT PROCESS WHICH MAKES POSSIBLE THE CHEMICAL DESTRUCTION OF SECURITIES OR PAPER DOCUMENTS

(75) Inventor: Philippe Besnard, Griselles (FR)

(73) Assignee: Brink's France, Paris (FR)

( * ) Notice: Subject to any disclaimer, the term of this patent is extended or adjusted under 35 U.S.C. 154(b) by 162 days.

(21) Appl. No.: 10/188,741

(22) Filed: Jul. 5, 2002

(65) Prior Publication Data

US 2003/0021898 A1 Jan. 30, 2003

(30) Foreign Application Priority Data

Jul. 6, 2001 (FR) ..... 01 09035

(51) Int. Cl.[7] ..... E05G 1/14; B05D 5/00

(52) U.S. Cl. ..... 427/7; 427/399; 427/439; 109/29; 156/155; 283/72; 283/95; 283/98

(58) Field of Search ..... 427/7, 399, 439; 109/29; 156/155; 283/72, 95, 98

(56) References Cited

U.S. PATENT DOCUMENTS

| | | | | | |
|---|---|---|---|---|---|
| 3,688,708 | A | * | 9/1972 | Meyerhoefer | 109/29 |
| 3,730,111 | A | * | 5/1973 | Matthews | 109/29 |
| 3,797,412 | A | * | 3/1974 | DiPaola et al. | 109/29 |
| 6,259,366 | B1 | * | 7/2001 | Lindskog et al. | 340/568.7 |
| 6,568,336 | B2 | * | 5/2003 | Van Lint | 109/29 |

* cited by examiner

*Primary Examiner*—Kirsten C. Jolley
(74) *Attorney, Agent, or Firm*—Young & Thompson

(57) ABSTRACT

The present invention relates to a chemical treatment process which makes it possible to modify the chemical structure of securities, bank notes or paper documents during their transportation or their storage, either in a vehicle or by a man on foot, thus making it impossible for criminals to be able to reuse them.

4 Claims, 1 Drawing Sheet

TREATMENT PROCESS WHICH MAKES POSSIBLE THE CHEMICAL DESTRUCTION OF SECURITIES OR PAPER DOCUMENTS

The present invention relates to a treatment process which makes it possible to modify the chemical structure of securities, bank notes or paper documents during their transportation or their storage, either in a vehicle or by a man on foot, thus making it impossible for criminals to be able to reuse them.

According to the invention, a chemical treatment process is provided which makes it possible to modify the chemical structure of securities, bank notes or paper documents during their transportation or their storage, either in a vehicle or by a man on foot, thus making it impossible for criminals to be able to reuse them.

According to other characteristics:

the physicochemical process is a polymerization or a crosslinking of the cellulose molecules of which the securities, bank notes or paper documents are composed, by dispersion of a chemical over the latter;

the product which makes possible the polymerization or the crosslinking of the cellulose molecules is a chemical of one of the following types:

carboxylic acids, to form esters (RCOOH),
alkanoyl halides, for esters (RCOX, where X is a halogen),
sulphonic acids, for sulphonic esters ($RSO_2OH$),
isocyanates, for urethanes or carbamates (RNCO),
phosgene, for carbonates.

Bank notes, or paper securities, and the like, are manufactured with paper prepared from cellulose. The principle which makes it possible to render these notes, securities or documents unusable is that of structurally modifying the existing molecules composing the structure of the bank notes or securities. This modification of the basic cellulose molecule is known as polymerization or crosslinking of the cellulose fibrils with one another.

The chemical formula of cellulose is as follows:

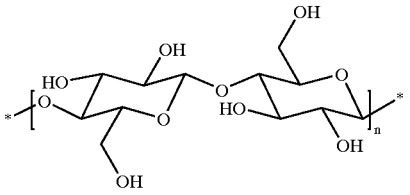

This formula reveals hydroxyl functional groups (—OH) capable of reacting with other chemical molecules. This is because alcohol, or hydroxyl, groups can react covalently with:

carboxylic acids, to form esters (RCOOH),
alkanoyl halides, for esters (RCOX, where X is a halogen),
sulphonic acids, for sulphonic esters ($RSO_2OH$),
isocyanates, for urethanes or carbamates (RNCO),
phosgene, for carbonates.

In order to provide for crosslinking in two or three dimensions, each type of product must exhibit at least two groups. These products are represented diagrammatically in the following way:

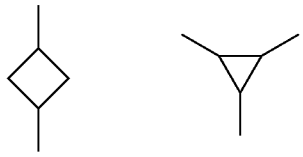

Bifunctional product  Trifunctional product

To avoid an intramolecular reaction of the same paper fibril, trifunctional substances will be favoured.

Figure 1:
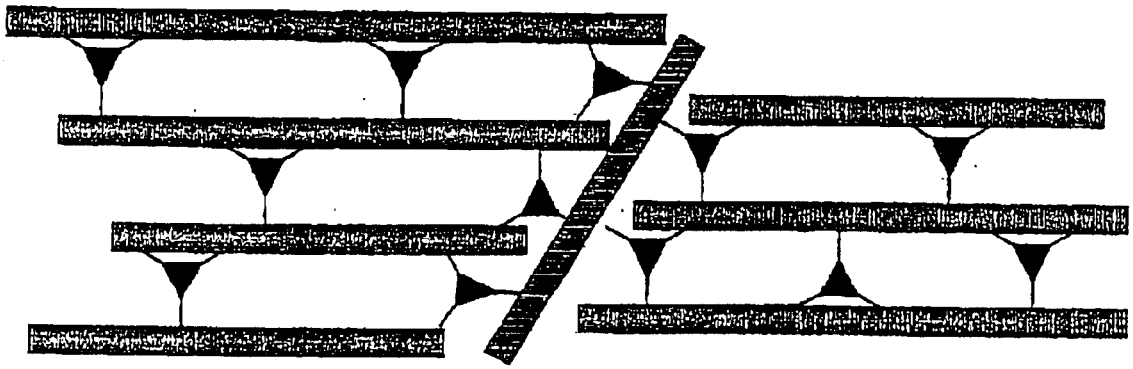
FIG. 1 illustrates the crosslinking of cellulose chains.

The principle of each reaction is addition and then elimination to form these crosslinking bridges.

Chemically, there are three reactions:

esterification,
formation of carbamate (urethane),
formation of carbonate.

The attachment of the crosslinking molecules, if it occurs, is irreversible because of the covalent nature. Indeed, very strong means, such as, for example, heating in an acid medium, would be necessary to destroy the covalent bond. However, the means used to destroy the interaction would result first in the destruction of the cellulose structure.

The chemical mechanisms for providing the polymerization or the crosslinking are as follows:

1. Esterification:

Four types of products may be acknowledged: carboxylic acids, acid chlorides or bromides, acid anhydrides and sulphonic acids. The advantage of these last two types is that of carrying out a complete and non-equilibrium reaction, as for the case of carboxylic acids. For the anhydrides, the molecule used should exhibit two functional groups, capable of bonding four times to the fibrils of the paper. The use of alkanoyl halides will require the use of a base, such as pyridine, to neutralize the hydrochloric or hydrobromic acid released by the reaction.

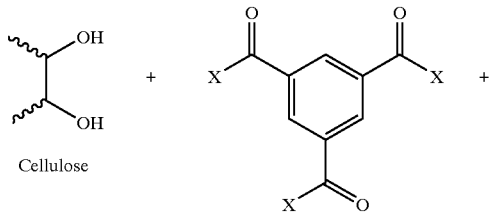

Cellulose  Trisubtituted substance

-continued

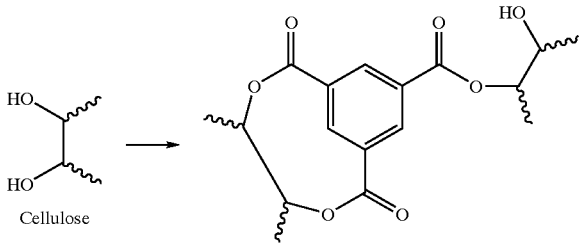

Crosslinked Cellulose

2. Formation of Carbamates

Carbamates are better known under the name of urethane. They are formed by virtue of the reaction of an alcohol with an isocyanate. The cellulose of the paper exhibits thousands of units each comprising at least three free alcohol functional groups. By reacting with a diisocyanate, crosslinking is capable of occurring.

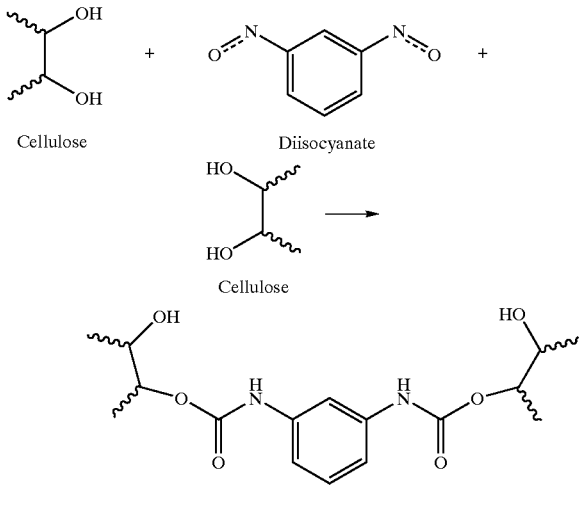

Crosslinked Cellulose

3. Formation of Carbonates

The reaction of phosgene with a diol makes it possible to polymerize the latter and to form a polycarbonate. As explained in the preceding section, cellulose is a polyol which can crosslink and can form a carbonate bridge with phosgene.

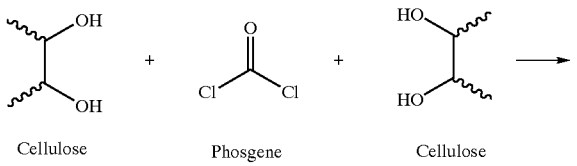

-continued

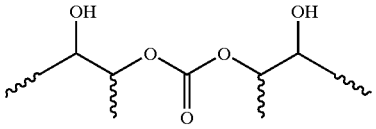

Crosslinked Cellulose

The dispersion over the securities or paper documents of one or more of the abovementioned products thus makes it possible to provide for their destruction.

This or these products are, for example, stored in one or more tanks in combination with a chamber for receiving the securities.

The dispersion is conventionally controlled.

What is claimed is:

1. A chemical treatment process for modifying the chemical structure of securities, bank notes or paper documents during their transportation or their storage, either in a vehicle or by a man on foot, thus making it impossible for criminals to be able to reuse them, comprising polymerizing or crosslinking cellulose fibrils to one another found in said securities, bank notes or paper documents by dispersion of a chemical over said securities, bank notes or paper documents.

2. The chemical treatment process according to claim 1, characterized in that the chemical which causes the polymerization or the crosslinking of the cellulose molecules is a chemical selected from the group consisting of carboxylic acids, alkanoyl halides, sulphonic acids, isocyanates, and phosgene.

3. A chemical treatment process for modifying the chemical structure of securities, bank notes or paper documents during their transportation or their storage, thus making it impossible for criminals to be able to reuse them, comprising polymerizing or crosslinking cellulose fibrils to one another found in said securities, bank notes or paper documents by dispersing a chemical over said securities, bank notes or paper documents.

4. The chemical treatment process according to claim 3, characterized in that the chemical which causes the polymerization or crosslinking of the cellulose molecules is a chemical selected from the group consisting of carboxylic acids, alkanoyl halides, sulphonic acids, isocyanates, and phosgene.

* * * * *